United States Patent [19]

Zimmerman

[11] Patent Number: 4,934,121

[45] Date of Patent: Jun. 19, 1990

[54] INTEGRATED REINFORCED CONCRETE WALL STRUCTURE

[75] Inventor: Melvin M. Zimmerman, Blue Bell, Pa.

[73] Assignee: Superior Walls of America, Ltd., Ephrata, Pa.

[21] Appl. No.: 297,871

[22] Filed: Jan. 12, 1989

[51] Int. Cl.[5] ..... E04C 1/10

[52] U.S. Cl. ..... 52/583; 52/602; 52/719

[58] Field of Search ..... 52/583, 602, 704, 705, 52/707, 125.5, 686, 719

[56] References Cited

U.S. PATENT DOCUMENTS

| | | | |
|---|---|---|---|
| Re. 23,074 | 1/1949 | Henderson . | |
| 735,228 | 8/1903 | Ellinger | 52/719 |
| 1,434,915 | 11/1922 | Scholfield | 52/719 X |
| 1,463,863 | 8/1923 | Zents | 52/707 X |
| 2,100,614 | 11/1937 | Schenk | 52/705 |
| 3,295,286 | 1/1967 | Schaich . | |
| 3,567,816 | 3/1971 | Embree | 52/602 X |
| 3,786,611 | 1/1974 | Brown . | |
| 3,808,755 | 5/1974 | Bott . | |
| 3,820,293 | 6/1974 | Ohe . | |
| 4,073,102 | 2/1978 | Fisher . | |
| 4,182,092 | 1/1980 | Weaver | 52/707 X |
| 4,189,890 | 2/1980 | Bains . | |
| 4,605,529 | 8/1986 | Zimmerman . | |
| 4,676,035 | 6/1987 | GangaRao | 52/583 X |

FOREIGN PATENT DOCUMENTS

| | | | |
|---|---|---|---|
| 723879 | 1/1932 | France | 52/686 |

*Primary Examiner*—Carl D. Friedman

*Attorney, Agent, or Firm*—Martin Fruitman

[57] ABSTRACT

A prefabricated concrete wall structure with an integrated, interconnected reinforcing structure within its various structural members. Each vertical stud and horizontal beam is formed with at least one reinforcing rod within it, and each reinforcing rod is connected to the reinforcing rods in abutting members. The wall section attachment fixture is also connected to the reinforcing rod in the structural member in which it is housed so that the integration of reinforcement is continued from section to section as the attachment fixtures are bolted together.

2 Claims, 4 Drawing Sheets

INTEGRATED REINFORCED CONCRETE WALL STRUCTURE

SUMMARY OF THE INVENTION

This invention deals generally with building construction and more specifically with the construction of concrete prefabricated walls.

U.S. Pat. No. 4,605,529 by Zimmerman, the same inventor as the present invention, describes a method of constructing a prefabricated concrete wall structure, and U.S. Pat. No. 4,751,803 also by Zimmerman, is a division of and describes and claims the wall structure constructed by the method of the former patent. These two patents describe a poured concrete wall structure which uses precast concrete studs around and upon which are cast concrete beams to form the top and base beams of a vertical wall with a concrete layer forming the outside sheath of the wall.

The present invention deals with improved construction, reinforcing and connecting means for prefabricated concrete wall structures. The previous structure and method, while using reinforcing rods only in the precast concrete studs, merely extended the reinforcing rods out the ends of the studs and cast the top and base concrete beams around them.

The present invention improves upon that structure by adding reinforcing rods to the concrete top and base beams and by integrating those added rods with those located in the vertical studs. This is accomplished by the use of a uniquely shaped shear connector which interconnects the reinforcing rod in the vertical stud to the rods in the top and base beams. This furnishes an integrated network of reinforcing rods which greatly increases the load strength of the resulting wall. Tests indicate that the load capacity of the finished wall at the centers of the vertically oriented studs increases from 30 psi to 60 psi when the integrated reinforcing rod network is added.

Another improvement for poured concrete walls which is offered by the present invention is the means for attaching wall sections to each other. While the previous patents described box structures cast into the top beam and base beam, continued use has shown that simple boxes do not have satisfactory strength. The present invention, therefore, uses an improved bolting saddle which is cast into the concrete wall so that two such walls can be bolted together.

The bolting saddle is formed of two hairpin wings of bent rod attached to a short metal plate with a through hole. The plate is located at the apex of an angle of approximately 45 degrees formed by the wings. A removable form fits within the angle during pouring of the concrete in order to prevent filling the volume behind the plate with concrete, so that access will be available for later insertion of nuts and bolts. An important feature of the bolting saddle is that the hairpin bent rod of the saddle is installed around and in contact with the reinforcing rods of the top and base beams before the wall is poured. This not only ties the two reinforcing rods in each beam together with the additional hairpin rod at the beam ends, but it also continues the integration of reinforcing rods from one wall section to another. Once the bolting saddles of two adjacent walls are firmly bolted together the reinforcing rods of the top and base beams of both sections are effectively integrated because not only the wall sections, but also the reinforcing rods are continuous.

The structure of an integrated network of reinforcing members is not limited to the wall structure of a wall which uses precast studs and forms the concrete wall around those studs. The integrated reinforcing system can also be used in a fully poured wall in which the studs, the top and base beam, and the outside sheath are all poured simultaneously. In such a system the reinforcing rods for the stud sections and the top and base beam sections are tied together before pouring, and all the wall structure is then poured around the rods.

The present invention therefore furnishes a system of prefabricated concrete walls in which the concrete reinforcing members are completely integrated within the entire wall. In the erected structure, regardless of the length or number of wall sections, the reinforcing members have been joined, both within the walls and by bolting them together at the wall section ends, into a single integrated network of reinforcing members. In a typical four walled structure this construction not only increases the strength at the center of each wall panel, as previously described, but it also substantially increases the overall stability of the entire wall structure, since it closely simulates placing tension bands around the exterior of a box structure. The result is a finished wall of superior strength and stability.

DETAILED DESCRIPTION OF THE INVENTION

Figure 1:
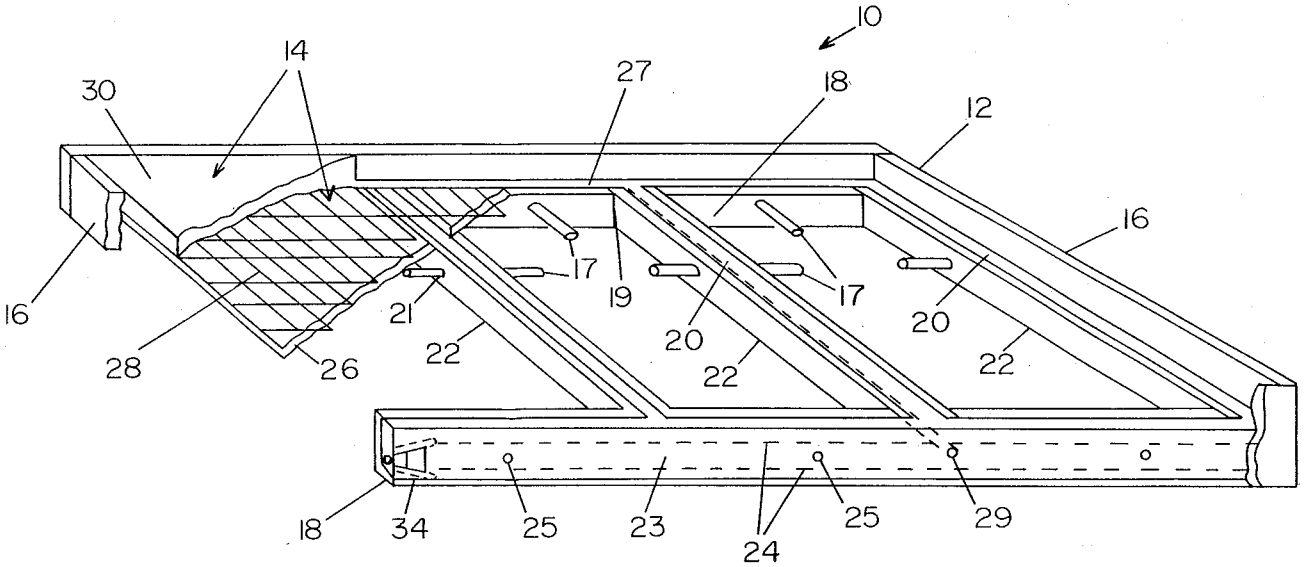
FIG. 1 is a cut-away perspective view of an assembled wall structure in an assembly jig.

The preferred embodiment of the invention is shown in FIG. 1, in a cut-away view, as it is just after the process of construction, in which assembly 10 contains both assembly jig 12 and assembled wall section 14. Both assembly jig 12 and wall section 14 are shown cut away so that the apparatus of the invention and the method of assembly can be better viewed.

Assembly jig 12 is formed essentially from framing member 16, which surrounds the periphery of the wall section, and support members 18 which locate and support stud molds 22 which are used to form the skeleton of wall section 14. Support members 18 and stud molds 22 have the basic shape of a channel or "u" which forms cavities which are approximately the same depth as the height of concrete studs 20 and beams 23 and 27. Support members 18 are supported on a table or other planar surface (not shown) and can even be simply supported by the earth. Their orientation to each other is parallel, such that they determine a configuration similar to top and bottom beams of conventional walls, and they have notches 19 in their inside walls so that stud molds 22 can be joined to them at notches 19 to form a box-like skeleton with occasional cross channels 22 between two parallel channels to form a total skeletal assembly.

Assembly jig 12 performs the task of locating the several concrete molds into the proper configuration to furnish the skeletal frame with which wall section 14 will be assembled.

Studs 20 are long members of essentially rectangular cross section which contain reinforcing rods 29 extending through their length. Studs 20 also include holes 21 through their thickness as various locations along their length. These holes serve to permit electrical cable and plumbing pipes to pass through them after the wall section is installed as a part of a building.

To construct wall section 14, reinforcing rods 29 are placed within molds 22 and reinforcing rods 24 are placed within support members 18 and they are wired together. Stud molds 22 are oriented perpendicular to support members 18 within which concrete will be poured. Reinforcing rods 29 are arranged to protrude from the ends of stud molds 22 and into the cavity of support members 18 so they can be attached to rods 24. The stud molds are located so only one is adjacent to frame member 16, and the internal stud molds of the skeletal framework extend fully between the support members 18.

Construction of wall section 14 then continues with the production of three successive layers of material onto the stud mold framework. The first layer installed is rigid insulation sheet 26. Insulation sheet 26 is laid across the entire framework except for the tops of stud molds 22 and support members 18 to form a complete surface, but is shown for clarity in FIG. 1 as only a small section.

The next layer installed is wire mesh 28 for reinforcement of the subsequent concrete layer. Wire mesh 28 is laid atop the entire surface formed by insulation sheet 26, but may also cover the tops of molds 22 and support members 18.

The final layer added is concrete 30. Conventional wet concrete is poured into the tray-like container formed by framing members 16 on the edges, stud molds 22, support members 18, and insulation sheet 26 as a bottom surface, with wire mesh 28 already in the "tray". Concrete is also poured into and fills the cavities of support members 18 and stud molds 22 thus forming two concrete beams 23 and 27 and studs 20 as one interlocking structure. When concrete 30 hardens it not only covers wire mesh 28 and insulation sheet 26, but it also encapsulates reinforcing rods 24 and 29 and their interconnected junctions, thereby forming a unitized structure with a completely integrated network of reinforcing rods.

All that is left to do after concrete 30 hardens is to lift wall section 14 out of assembly jig 12. This can be accomplished by jacking one edge of wall section 14 out of assembly jig 12 and then attaching lifting aids, such as eyebolts, through holes 25 in concrete beams 23 and 27. These holes are formed in beams 23 and 27 and holes 21 are formed in studs 20 by the use of cores 17. Before the concrete is poured cores 17 are set into predrilled holes in support members 18 and molds 22 and after the concrete sets cores 17 are tapped out to leave holes 25.

Figure 2:
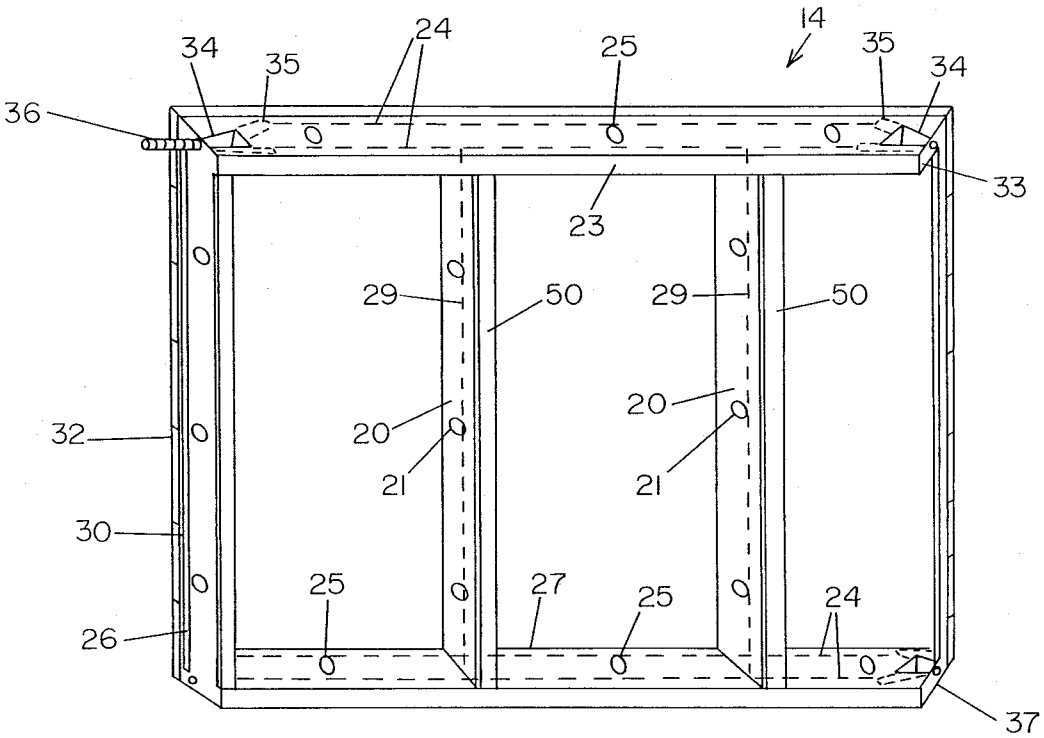
FIG. 2 is a perspective view of a finished wall section of the preferred embodiment.

FIG. 2 shows completed wall section 14 with the addition of decorative facing 32 onto the surface of concrete layer 30. This is accomplished quite simply by adding the decorative facing on top of the wet concrete before it sets. Decorative facing 32 can be any desired decoration such as thin brick facing. It can also be a particular surface finish upon the concrete itself, such as a stucco type finish or scribed lines to simulate stone.

FIG. 2 also shows the means for attaching wall sections 14 to each other to form longer sections or corners. To accomplish this, attachment structures 34 with hairpin rod wings 35 are placed within the cavities of support members 18 adjacent to the end of each section and attached to reinforcing rods 24 before pouring the concrete, and are encased within the concrete when it hardens. When the sections are later connected, this is done by inserting bolt 36 into a void in structure 34, which is formed as better described in regard to FIG. 3, and a nut into the matching structure on the adjacent section and threading them tightly together. For corner connections, beams 23 and 27 are formed with angled ends 33 and 37. This is accomplished quite simply by orienting one framing member 16 (FIG. 1) at an angle, which thereby causes concrete beams 23 and 27 to have ends with the same angle.

It should be apparent that the sequential layers of insulation sheet 26, concrete 30, and decorative facing 32 all may appear thicker in FIG. 2 than in actual wall sections, in order to depict the proper sequence of the layers. Wire mesh 28 is, of course, cast into concrete layer 30 and is therefore not visible to finished wall section 14.

Figure 3:
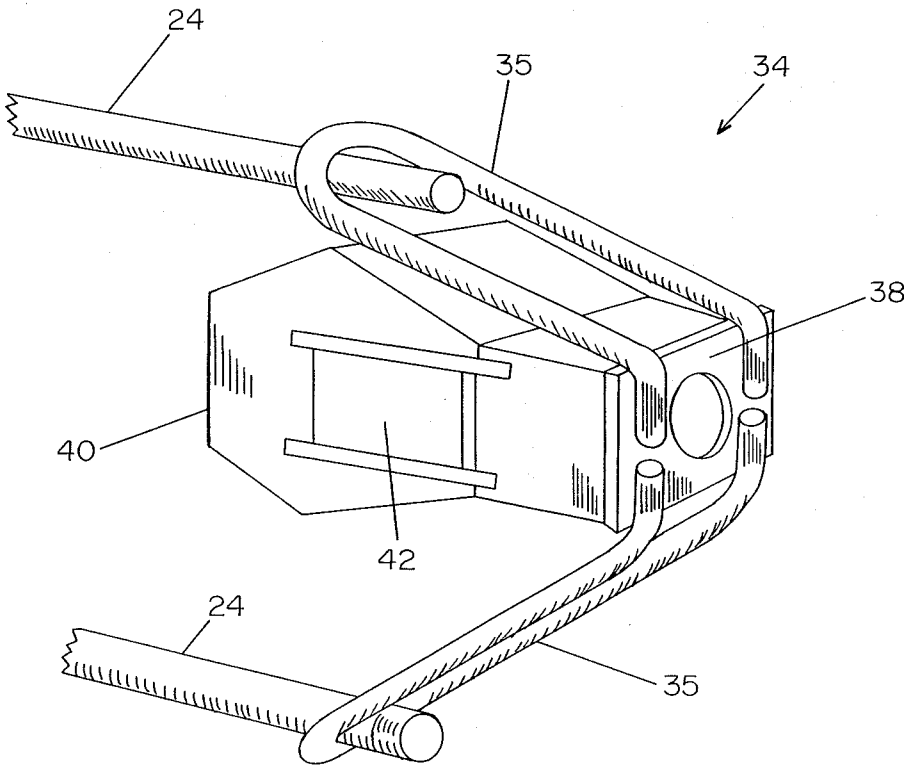
FIG. 3 is a perspective view of the attachment structure of the present invention which is used to anchor one wall section to an adjacent one.

FIG. 3 is a perspective view of the novel bolting saddle 34 of the invention. Bolting saddle 34 functions as the attachment structure between wall sections, since it is located within support member 18 and concrete is poured around it to encase it within top beam 23 or base beam 27.

Bolting saddle 34 is constructed of two wings 35 with rods formed into a hairpin or "U" shape and attached to plate 38 by welding. During the placement of reinforcing rods 24 and bolting saddle 34 within assembly 10 before concrete is poured, wings 35 are placed around and in contact with reinforcing rods 24. Therefore when the concrete sets, reinforcing rods 24 are not only effectively joined together but also bolting saddle 34 can be bolted to a similar saddle in an adjacent wall section to connect the reinforcing rods of the abutting wall sections.

In order to provide access for the bolts and nuts needed to attach bolting saddle 34 to an adjacent bolting saddle in an abutting wall section, removeable form 40 is located between wings 35 and behind plate 38. Form 40 is constructed of a material such as plastic which will not adhere to concrete and is held in place within assembly 10 by magnet 42 which is imbedded within form 40. Magnets 42 hold form 40 tightly against the sides of support members 18 before and during the pouring of the concrete, but release when the entire wall structure is removed from assembly 10, and then can easily be removed after the wall is free of assembly 10.

Figure 4:
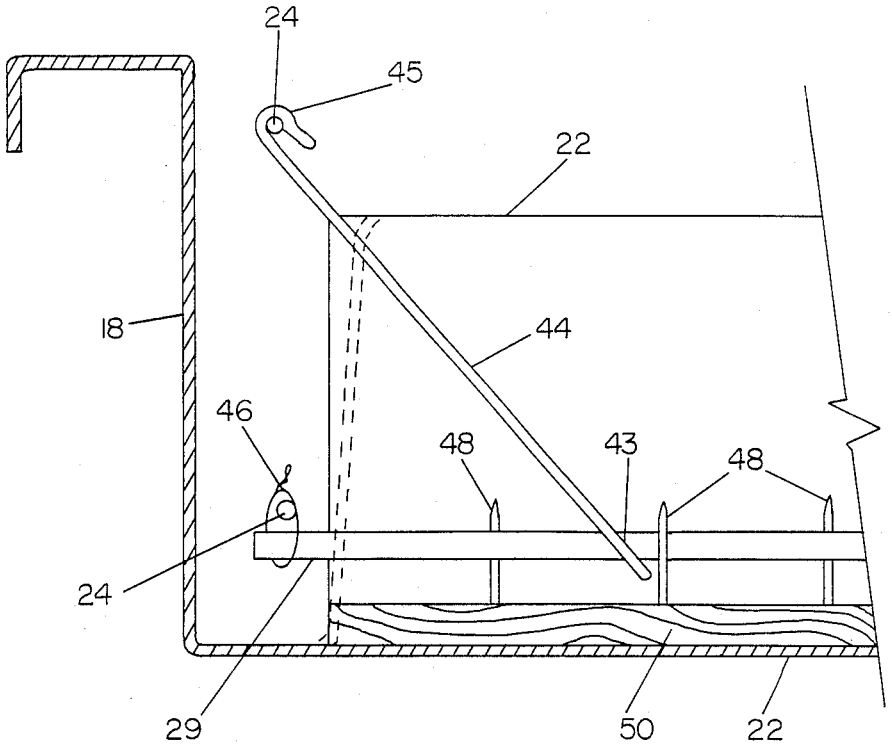
FIG. 4 is a cross section view of a section through the length of a stud mold 22 showing the arrangement for interconnecting reinforcing rods.

FIG. 4 shows how the other interconnection of reinforcing rods within wall structure 14 is accomplished. Before the concrete is poured reinforcing rod 29 within stud mold 22 is interconnected with upper reinforcing rod 24 within support members 18 by means of shear connector 44. Reinforcing rod 29 is also directly wired to lower reinforcing rod 24 by use of wire loop 46. Reinforcing rod 29 is itself supported within stud mold 22 by nails 48 which are attached to wood strip 50. Wood strip 50 located at the bottom of stud mold 22 will ultimately serve as a means to attach an inner wall to wall section 14.

Shear connector 44 is uniquely shaped to serve its purpose of interconnecting reinforcing rods 29 and 24. Both of its ends are formed as shown at end loop 45 to snap over and fit tightly around the reinforcing rods. End loop 43 of shear connector 44 is constructed the same as end loop 45 except that it is in a plane oriented at 90 degrees to the plane of end loop 45 so that it can fit around reinforcing rod 29 which is transverse to upper reinforcing rod 24. When installed and imbedded in concrete, shear connector 44 makes the reinforcing structure within wall 14 continuous and substantially increases the strength of the wall.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, the reinforcing material around which the concrete layer is poured can be standard concrete reinforcing rods or any other reinforcing structure. In fact the concrete layer 30 can even be constructed without a reinforcing structure, particularly if polypropylene fibers are mixed into the concrete to strengthen it by adding fiber.

What is claimed as new and desired to be secured by Letters Patent of the United States is:

1. A poured concrete wall structure including top and base beams with reinforcing rods and including attachment means cast into the top and base beams for attaching several wall structures together, wherein the attachment means comprises a pair of wings of hairpin formed rods joined by a plate with a through hole, with the wings interconnected with the reinforced rods of the beams, forming an angle of less than ninety degrees and including a void without concrete near their junction which permits the insertion of a connecting means after construction of the wall section is completed to hold adjacent wall sections together and to interconnect the reinforcing rods of adjacent wall sections.

2. A concrete wall section interconnecting means comprising:

a plate with a through hole; and two wing structures each attached to the plate and forming an angle of less than 90 degrees with the plate at the junction of the angle, the wings being formed of hairpin loops of rod, including a removeable form which fits within the angle formed by the wings and is constructed of material to which concrete will not adhere, and further including a magnet imbedded in the removeable form in order to hold the removeable form within a mold.

* * * * *